US005085308A

United States Patent [19]

Wilhelm

[11] Patent Number: 5,085,308

[45] Date of Patent: Feb. 4, 1992

[54] APPARATUS FOR COLLECTING ARTICLES

[75] Inventor: Rene Wilhelm, Zurich, Switzerland

[73] Assignee: EGAPRO Patent AG, Steckborn, Switzerland

[21] Appl. No.: 428,394

[22] Filed: Oct. 30, 1989

Related U.S. Application Data

[63] Continuation-in-part of Ser. No. 228,101, Aug. 15, 1988.

[30] Foreign Application Priority Data

Aug. 10, 1987 [JP] Japan ..... 62-3057
May 10, 1988 [CH] Switzerland ..... 1771/88

[51] Int. Cl.[5] ..... G07F 7/06; G07F 17/34

[52] U.S. Cl. ..... 194/205; 100/902; 194/209; 194/211

[58] Field of Search ..... 194/205, 208, 209, 211-213; 100/902; 273/138 A, 143 R

[56] References Cited

U.S. PATENT DOCUMENTS

| | | | |
|---|---|---|---|
| 3,129,004 | 4/1964 | Ritzler | 235/7 AX |
| 4,009,722 | 7/1978 | Rodesch et al. | 273/143 R |
| 4,051,939 | 10/1977 | Murphy et al. | 194/211 |
| 4,241,821 | 12/1980 | Wu et al. | 194/209 |
| 4,245,731 | 1/1981 | Herbst et al. | 194/209 |
| 4,324,325 | 4/1982 | Dewoolfson | 194/209 |
| 4,492,295 | 1/1985 | Dewoolfson | 194/212 X |
| 4,542,688 | 9/1985 | Bohan | 273/138 A |
| 4,573,954 | 3/1986 | Berger et al. | 273/138 A |
| 4,953,682 | 9/1990 | Helbawi | 100/902 X |

FOREIGN PATENT DOCUMENTS

| | | | |
|---|---|---|---|
| 1243097 | 10/1988 | Canada | 194/213 |
| 84699 | 5/1983 | Japan | 100/902 |
| 174299 | 10/1984 | Japan | 100/902 |
| 165299 | 7/1986 | Japan | 100/902 |
| 24896 | 2/1987 | Japan | 100/902 |

*Primary Examiner*—Frank E. Werner
*Assistant Examiner*—Brian K. Dinicola
*Attorney, Agent, or Firm*—Egli International

[57] ABSTRACT

An apparatus for collecting articles is housed in a parallelepipedic casing, on the front panel of which is arranged a display part of a playing part. An article-return part with an article-receiving container is also provided in the apparatus. The front panel of the casing is subdivided into a number of fields of which one field forms a door for an access to an article collecting container. A gaming machine is arranged in another field, and the article-return part in the third field. The gaming machine is at least partly visible through a window so that its game can be seen. Increased use of the apparatus results from the visibility and/or audibility of the game.

5 Claims, 1 Drawing Sheet

APPARATUS FOR COLLECTING ARTICLES

CROSS-REFERENCE TO RELATED APPLICATION

This application is a continuation-in-part of application Ser. No. 228,101 filed Aug. 15, 1988.

BACKGROUND OF THE INVENTION

The present invention relates to an apparatus for collecting articles which, depending on their type, are collected and undergo shape modification for recycling purposes or are dumped. More particularly, the invention relates to an apparatus having a gaming or playing part providing a user with an opportunity to win a prize. The apparatus is coupled with a container for accepting articles for the articles being collected.

The field of the present invention is recycling of materials, where efforts have been made to reduce prejudicing of the environment. These efforts are inter alia aimed at separating reusable materials from the waste, in order to reprocess them and prepare them for reuse.

Packs of all types and in particular metal packs, e.g. tin cans, aerosol containers and cans of all types represent vast quantities of used or spent materials. If it is possible to separate significant amounts of such metal packs from the waste material and supply same to reuse, this would not only considerably economize on the metal reserves of the world, but would also greatly reduce the quantity of garbage to be processed. However, it is important that it would be possible to recover these materials in considerable quantities and at low cost. It is therefore necessary firstly to collect such metal waste materials.

Numerous constructions of the devices of the foregoing type are known. Such devices essentially comprise a return or take-back part, which receives the articles to be collected. Such articles can be of widely differing types as mentioned above and may include empty tins or cans made from ferrous and non-ferrous metals, as well as plastic bottles and other plastic parts. The known apparatuses are also able to collect articles not usable for recycling purposes and which have to be dumped, such as e.g. batteries.

In order to prevent articles which are undesired from being delivered to the container for accepting articles of the apparatus and thus avoid damage to the container for accepting articles or prejudice the operation of the latter, the container for accepting articles must be equipped with a device, which would establish the acceptance of such articles and consequently allow the return thereof. The known devices have also means enabling the elimination of articles recognized as not being acceptable and which naturally require additional apparatus expenditure.

It has been also proposed to connect a playing or gaming part to the take-back or container for accepting articles aiming at motivating people to return articles being used. Although the return of the article to the collection device could put the playing part into operation, such process would take place without the user of the apparatus being able to follow the sequence of setting the playing part into operation. For better motivation purposes, it has been proposed to use a gaming machine as a gaming part, such as e.g. known so-called one-armed bandit which can be put into operation by inserting money into the apparatus. In order to be able to use the attraction or pull of such gaming machines in conjunction with devices for collecting articles, it has also been proposed to make use of the operating lever for e.g. manually deforming the article. It should be appreciated that through manual operation, admittedly, an extensive adaptation to the known construction is achieved and the attraction of such gaming machines is used. However, the disadvantage of such apparatuses resides in that they can be easily damaged or their operation can be prejudiced if the operating lever is not operated correctly by a user.

SUMMARY OF THE INVENTION

It is an object of the present invention to provide an improved apparatus for collecting articles of the aforementioned type, in which an increased motivation for a supply of the articles to be collected to the apparatus would be provided.

According to the invention, this and other objects of the invention are attained by an apparatus in which the playing part has a gaming machine connected to the article-container for accepting articles and is provided with an optical and/or acoustic display or indication, by means of which the user of the apparatus can directly observe and/or hear the sequence of the playing part operation. The gaming machine has a prize display with a possible direct or indirect delivery of the prize. The apparatus according to the invention further comprises a recognition device associated with the playing part, which, after establishing the acceptance of the article for the article collection, initiates the automatic switching into operation of the playing part and the optical and/or acoustic display or indication of the playing operation.

Thus, apart from the attraction of winning something, it is also made possible for the user, who introduces into the apparatus a recyclable object, e.g. an empty beverage can, to set in motion a game or lottery, the sequence of which he can directly observe and therefore participate in the fascination of the game. On linking this fascination with an advertisement for the apparatus connected with the performance of the game, a sales-encouraging effect extending far beyond the norm and advantageous to advertising companies and equipment installers is achieved.

The prize display should be optically and/or acoustically representable or communicatable.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

Figure 1:
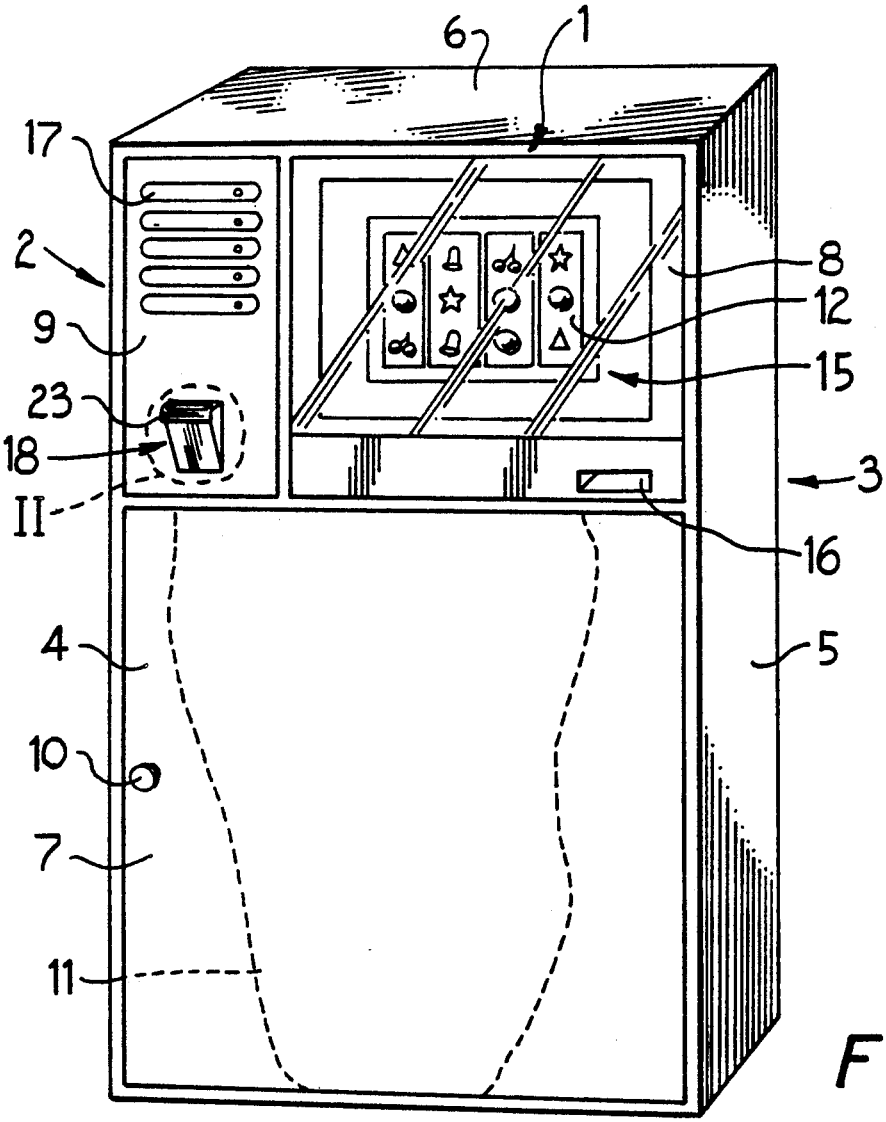
FIG. 1 is a diagrammatic perspective view of an apparatus for collecting articles, particularly cans, according to the invention.

The present invention is based on the idea that the playing urge of people can be much more successfully motivated for the collection of articles in order to protect the environment, if the particular apparatus, as in known gaming machines, shows the complete performance of the game and offers similar prize opportunities. The apparatus shown in FIG. 1 constitutes such a solution which may be used for collecting empty cans, e.g. aluminum cans. The apparatus comprises a playing or gaming part 1 and a return or take-back part 2. The playing part 1 and container for accepting articles 2 are enclosed in a common parallelepipedic casing 3, which is constructed of a front panel 4, side walls 5 and a non-shown rear wall, and has on the top surface thereof a cover 6 and on the bottom a non-shown base.

The front panel 4 is subdivided into three portions or fields 7, 8, 9. Field 7 forms the lower part of the panel 4 and is constructed as a door having an operating grip 10 for opening and closing purposes. The part of casing 3 located behind the door forms a cavity which houses an article-collecting means, e.g. a bag 11, in which are collected the articles returned by the user.

Behind field 8 is arranged a gaming machine 12, which can, e.g. be constructed as a conventional slot machine of any suitable type or an one-armed bandit, and which is at least partly visible through a window 15 provided for this purpose in field 8. Window 15 is substantially large to make it possible to observe the gaming machine 12 during the performance of the game.

In the embodiment shown in FIG. 1, the gaming machine 12 has a plurality of rotating rollers 12*a*, the position of which in the case of automatic or controllable stopping would indicate whether a prize had been won.

However, other solutions are also possible, e.g. an illuminated glass plate. Rollers 12*a* may have their circumferential surfaces provided with symbols, drawings and/or numbers formed as advertising media.

At the bottom edge of field 8, is located a prize discharge point 16, which has a correspondingly constructed opening. However, the prize discharge point 16 can be constructed in some other way. For example, instead of supplying prizes, the discharge point can be constructed for the direct delivery of the winnings obtained or for indirectly supplying the same in the form of a stamp or coupon.

It is important that the operation of the game can be followed on the gaming machine 12. Optionally the game can be supplemented by an acoustic background with music or speech and in all cases the fascination of known gaming machines must be retained.

In its upper part, field 9 has a plurality of pilot lights 17, which can be optionally provided with a text, e.g. giving information on the article in question. Lights 17 can be formed by lamps. A return flap 18 is provided below the row of pilot lamps 17 in the lower part of field 9. The return flap 18, as can be gathered from FIG. 2, can be pivoted about a horizontal shaft 19. The return flap 18 is essentially formed as a container 20, which has no bottom and which is used for receiving empty cans 21, e.g. aluminum cans. A stop 22 prevents can 21 received in container 20 from falling out. Return flap 18 has a handle 23 which, when the container 20 is in the vertical position, projects over the edge of the front panel 4 and can consequently be gripped and pivoted into the return or take-back position, in the manner shown in FIG. 2. Following the insertion of can 21, the return flap 18 is pivoted into the vertical position, whereupon a schematically-shown plunger 24 of an e.g. not shown conventional hydraulic press or pump is moved downwards and compresses the can 21 in container 20 which is at this point in its vertical position supported against a support 27. Thus, support 27 serves as a bearing block for plunger 24. If the container 20 is again pivoted about shaft 19 into the inclined position of FIG. 2 for the introduction thereinto of a further can, the compressed can 21 is moved by the lower edge 25 of container 20 away from support 27, so that it drops into the bag 11 provided in the lower part of casing 3. In the vicinity of the return flap 18, is provided a recognition or identification device 26 establishing the acceptance of the can 21.

Figure 2:
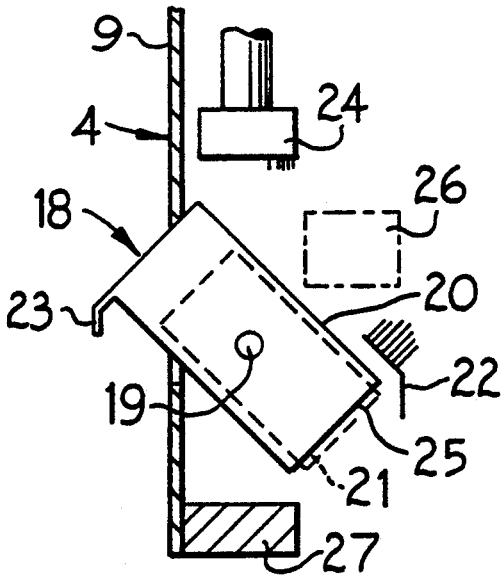
FIG. 2 is a section through the detail II encircled by broken line in FIG. 1 and showing the return opening on a larger scale.

The recognition or identification device 26 diagrammatically shown in FIG. 2 is of conventional type such as disclosed, for example, in European patent application 062,390 corresponding to U.S. application Ser. No. 248,022, filed Mar. 6, 1981 or U.S. Pat. No. 3,676,772 which are incorporated herein by reference. The aforementioned U.S. patent discloses a metal detection system with a receiver which generates a signal used to indicate the intrusion into the electromagnetic field of the electromagnetic transmitter of a metallic object so as to determine a relative size of the metallic object and its material. The recognition device of this type by detecting metallurgical properties of the material of the can determines the material of which the can is made. The aforementioned U.S. application Ser. No. 248,022 discloses a recognition device which determines whether an object is an aluminum can and comprises an oscillator circuit for generating a reference signal. A drive coil responsive to the reference signal emits a magnetic drive signal toward the object which is a can, and a sensor in the form of a sense coil is provided, which generates a detector signal from the magnetic drive signal after it has passed through the object being identified. The recognition device 26 is operatively connected to a motor of the hydraulic pump or press which operates plunger 24. A signal created by the can 21 present at the return flap 18 is identified in the recognition device 26 and is compared with a reference signal as disclosed in the above-mentioned U.S. application. The signal is delivered from the recognition device 26 only in the presence of non-ferrous metals, e.g. aluminum can and this signal can actuate a relay for starting the motor of the hydraulic pump for operating the plunger 24 to compress the can 21. The circuit of the recognition device 26 is also connected with a motor of the gaming machine. The same signal from the recognition device 26 starts the motor of the gaming machine.

If can 21 is not admitted by the recognition device 26, the plunger 24 and also the gaming machine 12 are blocked and are only set into operation again if can 21 admitted by the recognition device 26 is introduced into container 20.

It is important that the gaming machine 12 or the part thereof visible in window 15 is used as an advertising medium and, in particular, the movable and/or illuminated parts of the gaming machine 12 are suitable for this purpose. The advertising medium is also used for playing for a prize.

It is important that the use of the gaming machine 12 be directly linked with the return of an article. Only when the recognition device 26 has established the admissibility of the article, the gaming machine game is switched into operation, so that the user has a chance of winning a prize. The game takes place in such a way that it is visible and/or audible for the user. This visibility and audibility decisively increases motivation and ensures that the apparatus has a corresponding high level of use.

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. Apparatus for receiving and selectively collecting articles, comprising:

a casing;

a container for accepting an article to be selectively collected, having side walls, a flap on the first end and an open bottom on the second end;

a recognition device for selecting or rejecting an article in the container;

an article retaining stop for retaining the article in the container during recognition;

means for reducing the shape of a selected article retained in the container, said means for reducing the shape being connected to said recognition device;

a pivot shaft mounted between said side walls and said casing, said pivot shaft defining a container pivot axis whereby said container is pivotable about said container pivot axis into an inclined position and into a position of axial alignment with said means for reducing the shape of said selected article;

a collecting device for receiving an article reduced in shape by said means for reducing the shape of a selected article, whereby said article reduced in shape is transferred from said container to said collecting device when said container is in said inclined position;

a gaming device electrically connected to said recognition device, said gaming device comprising an integral gaming machine having means to determine randomly whether to award a prize and having an optical display portion comprised of a plurality of rotating rollers, each rotating roller provides on its circumferential surface a sequence of visible displays of symbols that represent winning of a prize when said symbols on said rotating rollers are aligned in predetermined combinations; and a prize dispenser connected to the gaming machine, whereby a prize is dispensed when said symbols are aligned in one of said predetermined combinations.

2. An apparatus according to claim 1, wherein the gaming machine is connected to an acoustical indicator.

3. An apparatus according to claim 1, wherein the optical display of the gaming machine is in the form of text display.

4. An apparatus according to claim 1, wherein the gaming machine is placed behind a glass window in the casing.

5. An apparatus for receiving and selectively collecting articles, comprising:

a casing;

a container for accepting an article to be selectively collected having sidewalls, a flap on the first end, and an open bottom on the second end;

a recognition device for selecting or rejecting an article in the container during recognition;

means for reducing the shape of a selected article retained in the container, said means for reducing the shape being connected to said recognition device;

a pivot shaft mounted between said sidewalls and said casing, said pivot shaft defining a container pivot axis whereby said container is pivotable about said container pivot axis into an inclined position and into a position of axial alignment with said means for reducing the shape of said selected article;

a collecting device for receiving an article reduced in shape by said means for reducing the shape of said selected article, whereby said article reduced in shape is transferred from said container to said collecting device when said container is in said inclined position;

a gaming device electrically connected to said recognition device, said gaming device comprising an integral gaming machine having means to determine randomly whether to award a prize and having an optical display device comprised of a plurality of illuminated glass plates, wherein each of said illuminated glass plates provides a visible sequential display of symbols that represent a winning of a prize when said symbols on said plates are aligned in predetermined combinations; and a prize dispenser connected to said gaming machine, whereby a prize is dispensed when said symbols are aligned in one of said predetermined combinations.

* * * * *